US006122826A

United States Patent [19]

Coffin et al.

[11] Patent Number: 6,122,826

[45] Date of Patent: Sep. 26, 2000

[54] DISPOSABLE CARTRIDGE HOLDER FOR SINGLE DIRECTION PIVOTING CARTRIDGE

[75] Inventors: David Coffin, Milford; Andrew Pennella, Stamford, both of Conn.

[73] Assignee: Warner-Lambert Company, Morris Plains, N.J.

[21] Appl. No.: 09/064,201

[22] Filed: Apr. 22, 1998

[51] Int. Cl.[7] ..... B26B 21/00

[52] U.S. Cl. ..... 30/57; 30/527

[58] Field of Search ..... 30/50, 527, 531, 30/57

[56] References Cited

U.S. PATENT DOCUMENTS

| | | | |
|---|---|---|---|
| 1,059,487 | 4/1913 | Rich | 30/531 |
| 1,297,413 | 3/1919 | Stephenson | 30/50 |
| 1,317,748 | 10/1919 | Zimmerman | 30/50 |
| 1,332,587 | 3/1920 | Yeomans | 30/50 |
| 1,395,334 | 11/1921 | Behrman | 30/50 |
| 1,643,757 | 9/1927 | Wallenbeck | 30/50 |
| 2,188,131 | 1/1940 | Bois | 30/50 |
| 4,227,302 | 10/1980 | Torrance | 30/527 |
| 4,970,784 | 11/1990 | Althaus et al. . | |
| 4,993,154 | 2/1991 | Radcliff | 30/527 |
| 5,333,383 | 8/1994 | Ferraro | 30/527 |
| 5,600,887 | 2/1997 | Olson | 30/527 |

FOREIGN PATENT DOCUMENTS

| | | |
|---|---|---|
| 0203527 | 3/1986 | European Pat. Off. . |
| 2066133 | 7/1981 | United Kingdom . |
| 2081165 | 2/1982 | United Kingdom . |
| 9904938 | 2/1999 | WIPO . |

*Primary Examiner*—Rinaldi I. Rada
*Assistant Examiner*—Kim Ngoc Tran
*Attorney, Agent, or Firm*—Charles W. Almer

[57] ABSTRACT

An adapter used to mount a single direction pivoting cartridge on a disposable razor. The adapter may be either integral with the handle or a removable adapter. A spring tongue member or spring arm biases the cartridge to its at-rest position and provides a restoring moment when the cartridge is pivoted during use.

16 Claims, 6 Drawing Sheets

DISPOSABLE CARTRIDGE HOLDER FOR SINGLE DIRECTION PIVOTING CARTRIDGE

FIELD OF THE INVENTION

The present invention is directed to a holding means for mounting a single directional pivoting cartridge on a razor handle.

BACKGROUND OF THE INVENTION

Razor cartridges which pivot in a single direction are known in the shaving art. Examples of such pivots include those razors sold around the world under the PROTECTOR trademark, as well U.S. Pat. No. 5,533,263, assigned to The Gillette Company. Generally, the commercially available single direction pivot razors contain a pivot axis which is offset towards one side of the cartridge. This offset is most commonly on the guard side of the cartridge. In the at-rest position, single direction pivot razors are usually biased to an acute angle from a general axis along the handle means. This angle is usually about 45 degrees as measured from the plane of the blade or blades. During use, forces encountered during shaving cause the cartridge to pivot backwards, commonly to an angle of about 80–90 degrees to the handle. In contrast, standard commercially available razor systems which provide bi-directional pivoting generally have an at-rest cartridge position which is at an angle of about 65 degrees to the handle. However, no disposable systems exist for providing a single directional pivotal cartridge having a spring means which returns the cartridge to its at-rest position after encountering forces during shaving.

Based on the foregoing, it would be desireable to provide a disposable razor cartridge holder means which incorporates a spring means in order to return a single direction pivotal cartridge to its at-rest position.

SUMMARY OF THE INVENTION

The present invention is directed to an adapter used to mount a single direction pivoting cartridge on a disposable razor. The adapter may be either integral with the handle or a removable adapter. A spring tongue member or spring arm biases the cartridge to its at-rest position and provides a restoring moment when the cartridge is pivoted during use.

DETAILED DESCRIPTION OF THE PREFERRED EMBODIMENTS

Figure 1:
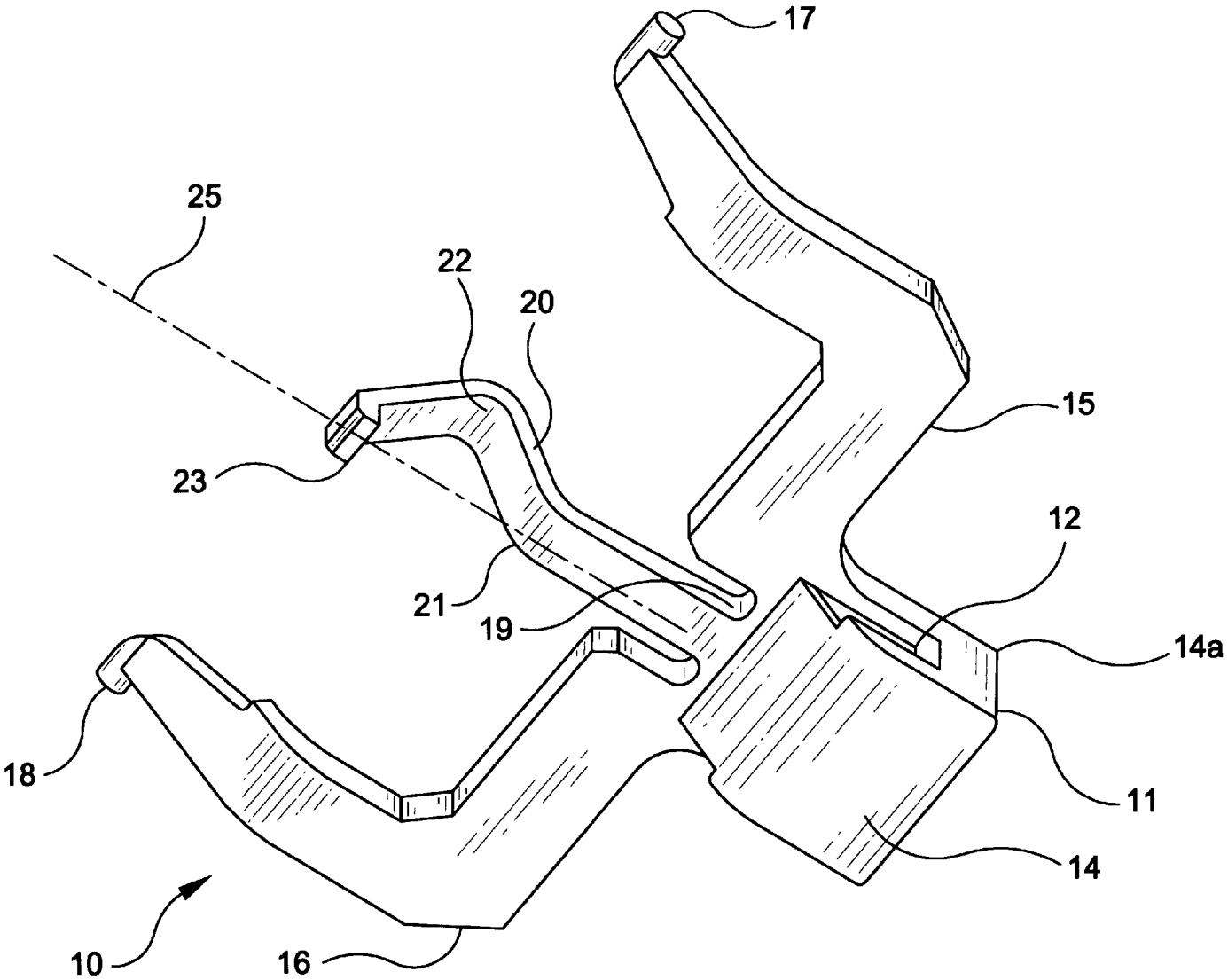
FIG. 1 is a perspective view of the holding means.

Reference will now be made to the presently preferred embodiments of the present invention. FIG. 1 illustrates a preferred embodiment of the adapter 10 of the present invention. While the adapter illustrated is intended to be mounted on a handle member, it is within the scope of the invention to extend the adapter to form a complete handle such that the handle and the adapter are integral with each other. The adapter 10 comprises an attachment means for attachment to a razor handle. The preferred attachment means is a single point attachment comprising socket 11 which consists of an opening surrounded by four side walls (top wall 14 and side wall 14*a* are visible in the illustration). The socket is capable of receiving an attachment means, preferably in the form of an outwardly extending arm or arms, on the upper end of a razor handle (not illustrated). Preferably, the socket contains openings 12 which provide a locking snap fit between the handle and the adapter so that the handle and adapter form a tight unit which will not be negatively affected by forces encountered during shaving. Arms 15, 16 have a lower portion which extends outward from the socket area of the adapter in a direction generally perpendicular to the handle and an upper portion which is substantially parallel with the handle. Projections 17, 18 extend outward from the upper ends of the arms for engagement with the cartridge. The projections are such that each snaps into an opening in the cartridge to attach the cartridge to the adapter. Preferably, the projections are rounded in order to enhance the pivoting action of the cartridge.

Figure 2A:
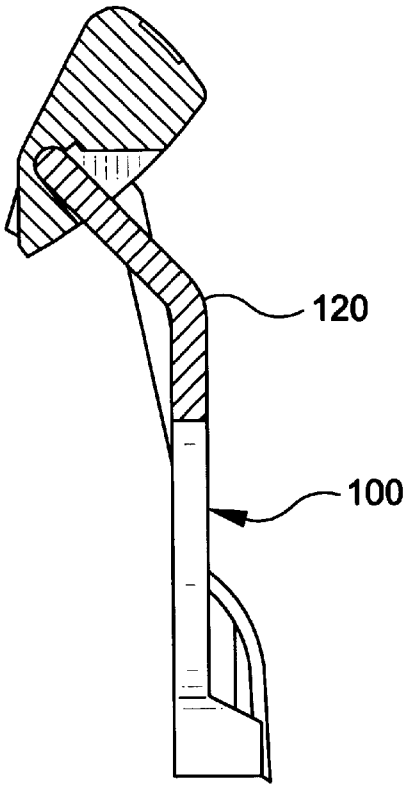
FIG. 2*a* is a cut-away view along line 2—2 of the holding means and cartridge in the at-rest position.
Figure 2:
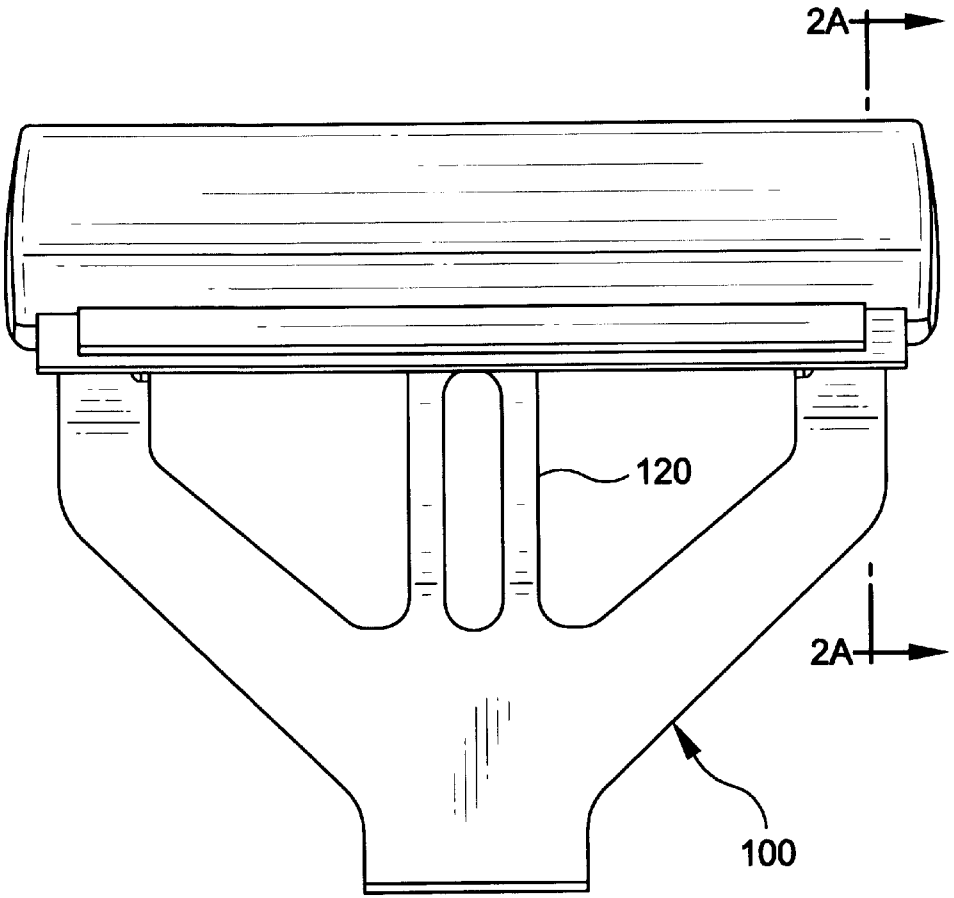
FIG. 2 is a front view of the holding means and a cartridge in the at-rest position.
Figure 3A:
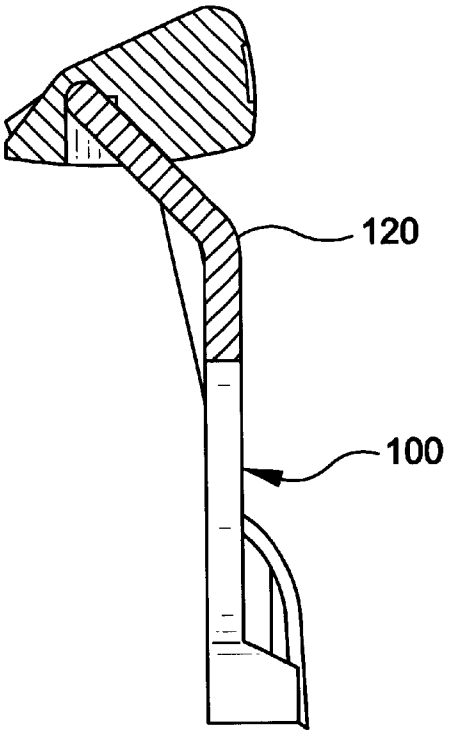
FIG. 3*a* is a cut-away view along lines 3—3 of the holding means and a cartridge in a biased position.
Figure 3:
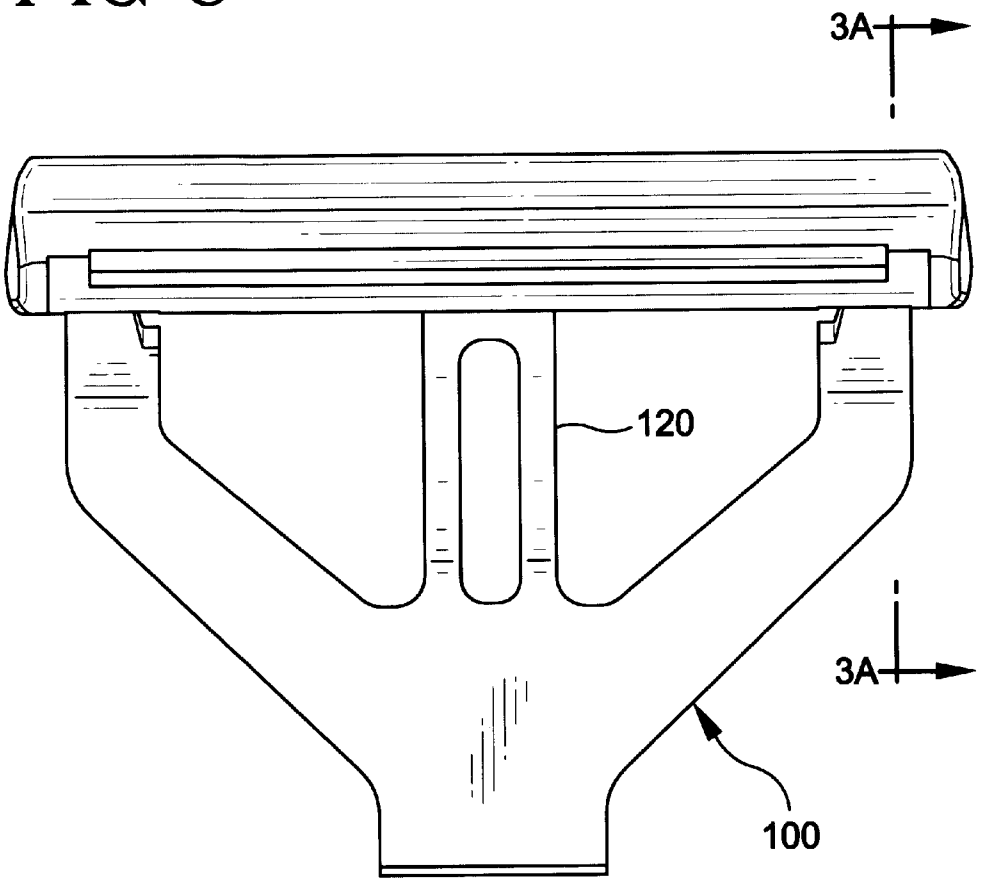
FIG. 3 is a front view of the holding means and a cartridge in the biased position.

Spring tongue member 20, illustrated in its at-rest position, extends outward from notch 19 in the adapter. Notch 19, and hence the base of the spring tongue member, is located adjacent to the inner portion of socket 11 at a point between arms 15, 16. Spring tongue member extends outward, away from notch 19, to a point approximately between projections 17, 18. The outermost point of the spring tongue member 23 is adapted to accommodate the desired cartridge for the razor system. As illustrated in FIGS. 2 and 2*a* (with a further preferred embodiment of the adapter), the normal bias force from the spring tongue member will retain the cartridge in an at-rest position such that the plane of the cutting edge of the blades is at an angle of about 45 degrees to the handle. Preferably, spring tongue member 20 contains a plurality of flexure points 21, 22. Shoulder 23 provides a contact location upon which the base of the cartridge rests. Upon the exertion of forces upon the cartridge during shaving, the cartridge will pivot backward as far as allowed by the spring tongue member and spring tongue member 20 will compress in length via bending about radii which extend through flexure points 21, 22 and are perpendicular to the spring tongue member. Preferably, the spring tongue member will restrict the cartridge from pivoting beyond an angle of approximately 90 degrees between the plane of the cutting edge of the blade or blades and the handle, as illustrated in FIGS. 3 and 3*a* (with a further preferred embodiment of the adapter). When the cartridge is pivoting the entire spring tongue member will bend about plane 25 which extends throughout the length of the spring tongue member. Upon the release of the forces, the spring tongue member is sufficiently resilient such that it will straighten and the cartridge will pivot forward and be returned to its at-rest position.

Figure 4:
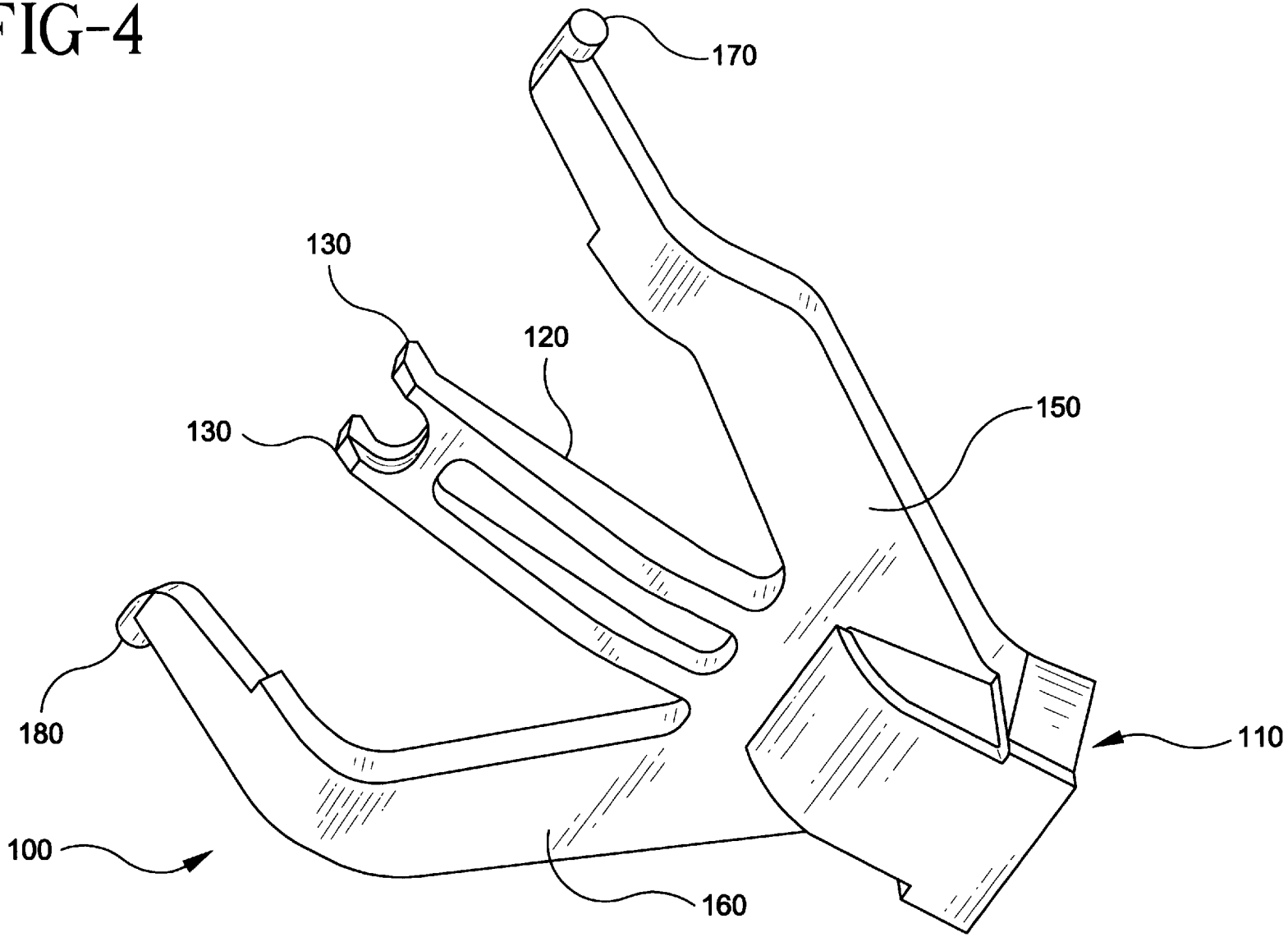
FIG. 4 is a perspective view of a further embodiment of the holding means having a center spring tongue with a notch at its extreme tip.

FIG. 4 illustrates an alternative preferred embodiment of the adapter 100. In this preferred embodiment the spring tongue member 120 extends outward from the socket area 110 of the adapter. Arms 150, 160 each comprise a lower portion which extends outward at approximately a 45 degree angle to the handle and an upper portion which is substantially parallel with the handle. Projections 170, 180 extend outward from the outermost end of the arms to attach a cartridge. The spring tongue member 120 is substantially straight and does not contain any overt flexure points as does the previous embodiment. Tabs 130 protrude from the outermost end of the spring tongue member. The tabs are engageable with a slot provided in the cartridge to aid in retention of the cartridge on the adapter. Upon encountering forces during shaving, the cartridge pivots backward and the spring tongue member bends backward along a plane through the center of the spring tongue member and parallel with the razor handle. When the forces are released, the spring tongue member returns the cartridge to its at-rest position.

Figure 5:
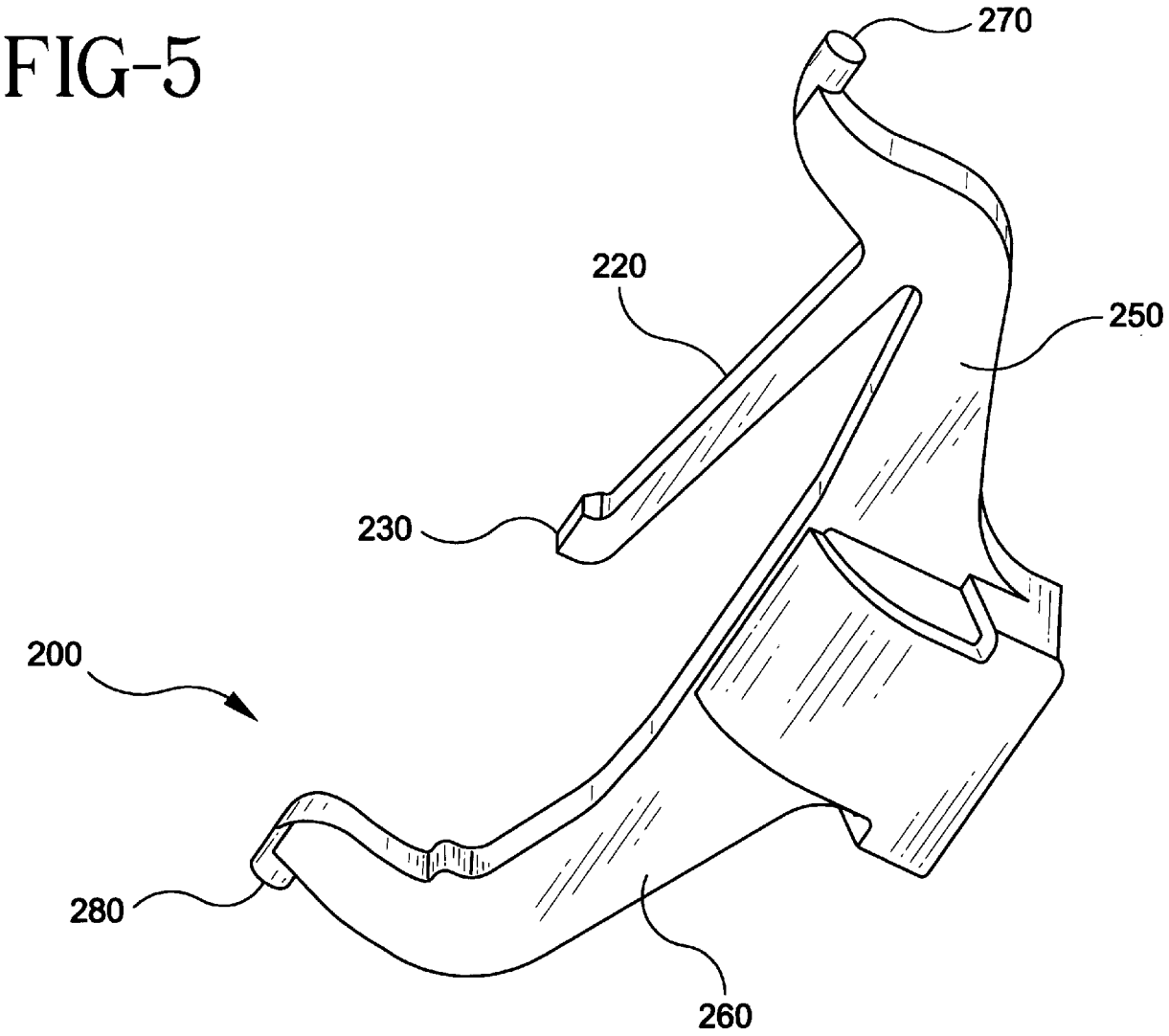
FIG. 5 is a perspective view of a further embodiment of the holding means having one or more spring arms which project inward from the side arms.

FIG. 5 illustrates a further preferred embodiment of the adapter 200. In this preferred embodiment, one or more spring arms extend in ward from on e or both of the arms. As illustrated, the spring arm 220 extends inward from arm 250, however a spring arm may also extend inward from arm 260, either in addition to or instead of spring arm 220. Shoulder 230 provides a contact location upon which the cartridge rests. Upon the exertion of force during shaving, the cartridge will pivot backward and the spring arm or arms will act in torsion to bend about a plane which extends throughout the length of the arm or arms and is substantially perpendicular to the handle.

Figure 6:
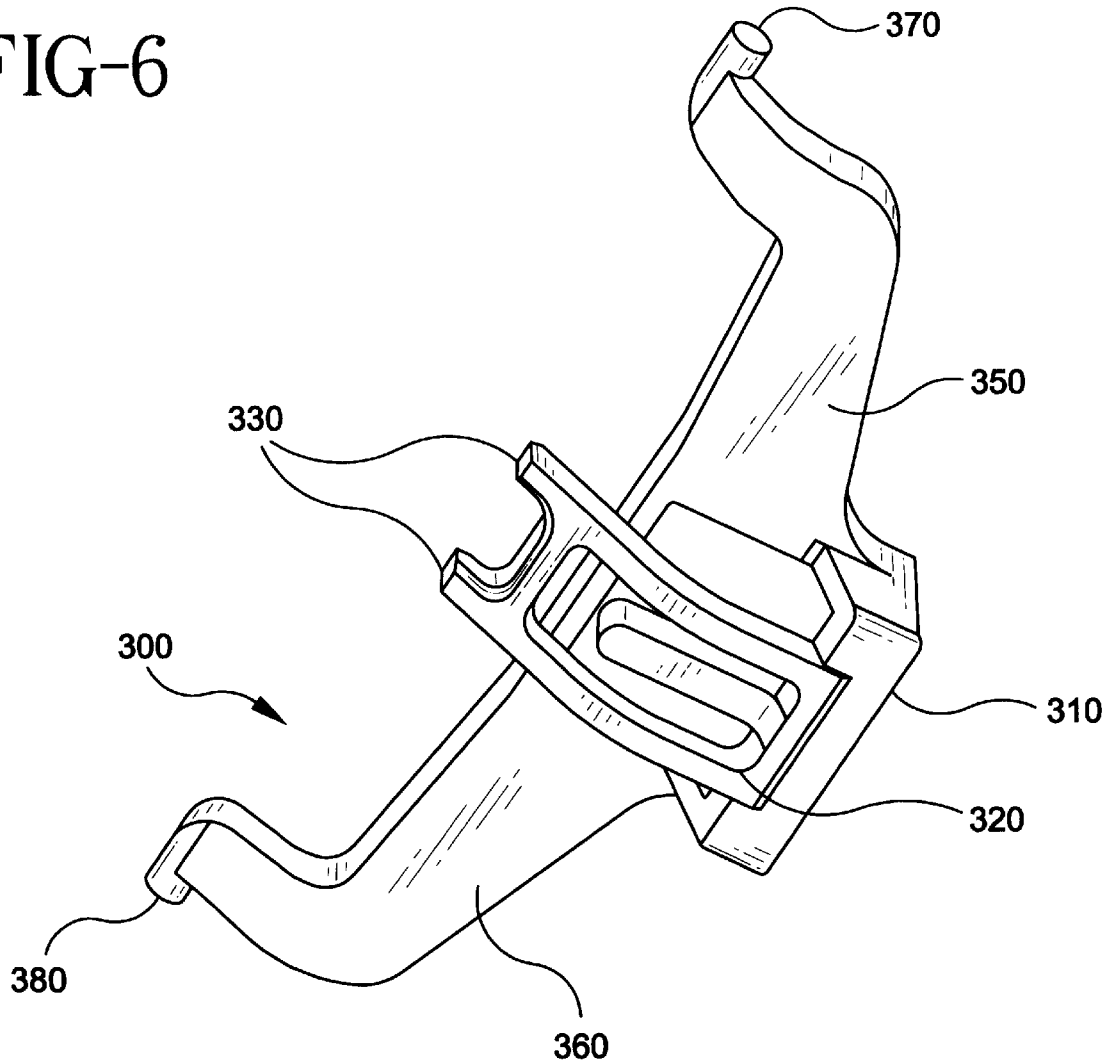
FIG. 6 is a perspective view of a further embodiment of the holding means having the restoring spring on top of the socket.

FIG. 6 illustrates another preferred embodiment of the adapter 300. In this preferred embodiment the spring tongue member 320 extends outward from the top of the socket adapter 310. Arms 350,360 each comprise a lower portion which extends outward approximately perpendicularly to the razor handle and an upper portion which extends approximately parallel to the razor handle. Projections 370, 380 extend outward from the outermost ends of the arms to attach a cartridge. As illustrated, the spring tongue member preferably curves gradually inward throughout its length so that tabs 330, which form the outer end of the spring tongue member, are substantially on the same plane as projections 370,380 and provide a contact location upon which the cartridge may rest. Upon the exertion of force during shaving, the cartridge will pivot backward and the spring tongue member will bend downward.

While there have been described what are presently believed to be the preferred embodiments of the present invention, those skilled in the art will realize that various changes and modifications may be made to the invention without departing from the spirit of the invention, and it is intended to claim all such changes and modifications as fall within the scope of the invention.

We claim:

1. An adapter for attaching a disposable cartridge to a razor handle comprising an attachment portion for attaching the adapter to a razor handle, a spring tongue member, and two arms each having a projection for the attachment of a razor cartridge, wherein the spring tongue member contains two flexure points and flexes about a point in each of the flexure points in a manner which allows the cartridge to pivot in one direction over a range of approximately 45 degrees in response to forces encountered during shaving.

2. An adapter according to claim 1, wherein the spring tongue member flexes about a plane substantially parallel to the razor handle in response to forces encountered during shaving.

3. An adapter according to claim 2, wherein the spring tongue member comprises sufficient resilience to return the cartridge from a pivoted position to an at-rest position.

4. An adapter according to claim 3, wherein the adapter is integrally formed with a razor handle.

5. An adapter according to claim 1, wherein the spring tongue member is substantially straight.

6. An adapter according to claim 5, wherein the spring tongue member flexes about a plane substantially parallel to the razor handle in response to forces encountered during shaving.

7. An adapter according to claim 6, wherein the spring tongue member comprises sufficient resilience to return the cartridge from a pivoted position to an at-rest position.

8. An adapter according to claim 7, wherein the adapter is integrally formed with a razor handle.

9. An adapter according to claim 1, wherein the spring tongue member is positioned on the attachment means.

10. An adapter according to claim 9, wherein the spring tongue member flexes about a plane substantially parallel to the razor handle in response to forces encountered during shaving.

11. An adapter according to claim 10, wherein the spring tongue member comprises sufficient resilience to return the cartridge from a pivoted position to an at-rest position.

12. An adapter according to claim 11, wherein the adapter is integrally formed with a razor handle.

13. An adapter for attaching a disposable cartridge to a razor handle comprising an attachment portion for attaching the adapter to a razor handle, one or more spring arms, and two arms each having a projection for the attachment of a razor cartridge, wherein at least one spring arm is affixed to one arm and flexes about a plane substantially perpendicular to the razor handle in response to forces encountered during shaving and the at least one spring arms permit pivoting of the cartridge in a single direction, and wherein the at least one spring arm comprises sufficient resilience to return the cartridge from a pivoted position to an at-rest position.

14. An adapter according to claim 13, wherein one spring arm is affixed to each of the two arms.

15. An adapter according to claim 14, wherein the spring arm flexes about a plane substantially perpendicular to the razor handle in response to forces encountered during shaving.

16. An adapter according to claim 15, wherein the spring arm comprises sufficient resilience to return the cartridge from a pivoted position to an at-rest position.

* * * * *